US011832774B2

(12) United States Patent
Li et al.

(10) Patent No.: US 11,832,774 B2
(45) Date of Patent: Dec. 5, 2023

(54) METHOD FOR DETECTING SKIDDING OF ROBOT, MAPPING METHOD AND CHIP

(71) Applicant: AMICRO SEMICONDUCTOR CO., LTD., Guangdong (CN)

(72) Inventors: Yongyong Li, Guangdong (CN); Gangjun Xiao, Guangdong (CN)

(73) Assignee: AMICRO SEMICONDUCTOR CO., LTD., Guangdong (CN)

( * ) Notice: Subject to any disclaimer, the term of this patent is extended or adjusted under 35 U.S.C. 154(b) by 758 days.

(21) Appl. No.: 16/645,492

(22) PCT Filed: Aug. 6, 2018

(86) PCT No.: PCT/CN2018/098914
§ 371 (c)(1),
(2) Date: Mar. 9, 2020

(87) PCT Pub. No.: WO2019/052285
PCT Pub. Date: Mar. 21, 2019

(65) Prior Publication Data

US 2020/0275816 A1 Sep. 3, 2020

(30) Foreign Application Priority Data

Sep. 12, 2017 (CN) ..... 201710818702.4

(51) Int. Cl.
*A47L 11/24* (2006.01)
*A47L 9/00* (2006.01)
(Continued)

(52) U.S. Cl.
CPC ..... *A47L 11/24* (2013.01); *A47L 9/009* (2013.01); *A47L 9/2852* (2013.01); *A47L 11/4011* (2013.01); *A47L 2201/04* (2013.01)

(58) Field of Classification Search
CPC ..... A47L 11/24; A47L 9/009; A47L 9/2852; A47L 11/4011; A47L 2201/04
See application file for complete search history.

(56) References Cited

U.S. PATENT DOCUMENTS

2006/0023815 A1 10/2006 Malm
2008/0154429 A1* 6/2008 Lee ..... G05D 1/027 901/1
(Continued)

FOREIGN PATENT DOCUMENTS

CN 101600618 A 12/2009
CN 102666032 A 9/2012
(Continued)

*Primary Examiner* — Marc Carlson
(74) *Attorney, Agent, or Firm* — Yu Gang

(57) ABSTRACT

The present disclosure relates to a method for detecting a skidding of a robot, a mapping method and a chip. A method for detecting a skidding of a robot, comprising the following steps: By an odometer on existing driving wheels of a robot and a gyroscope and a processor in a body of the robot, a first angle change rate generated by two driving wheels within a preset time and a second angle change rate generated by the gyroscope within the preset time are detected and calculated, so as to determine an angular velocity change error rate of the robot. Finally, by judging whether the angular velocity change error rate is greater than or equal to a preset value, it is determined whether the robot is in the skidding state.

8 Claims, 3 Drawing Sheets

(51) Int. Cl.
*A47L 11/40* (2006.01)
*A47L 9/28* (2006.01)

(56) References Cited

U.S. PATENT DOCUMENTS

| | | | | |
|---|---|---|---|---|
| 2010/0023220 | A1* | 1/2010 | Nakashima | B62K 11/007 701/42 |
| 2012/0219207 | A1* | 8/2012 | Shin | G05D 1/0272 901/50 |
| 2016/0007523 | A1 | 1/2016 | Rylander | |
| 2020/0031226 | A1* | 1/2020 | Haegermarck | A47L 9/2826 |

FOREIGN PATENT DOCUMENTS

| | | | | |
|---|---|---|---|---|
| CN | 105242675 | A | | 1/2016 |
| CN | 106933229 | A | | 7/2017 |
| CN | 107348910 | A | | 11/2017 |
| CN | 107443430 | A | | 12/2017 |
| EP | 2495079 | A1 | | 9/2012 |
| KR | 20060032880 | A | | 4/2006 |
| KR | 20070108618 | A | | 11/2007 |
| KR | 20120059427 | A | * | 6/2012 |
| WO | 2015197332 | A1 | | 12/2015 |

* cited by examiner

METHOD FOR DETECTING SKIDDING OF ROBOT, MAPPING METHOD AND CHIP

CROSS-REFERENCE TO RELATED APPLICATIONS

The present disclosure claims priority to Chinese Patent Application No. 201710818702.4, entitled "method for detecting skidding of Robot, mapping method and chip", filed on Sep. 12, 2017, the contents of which are hereby incorporated by reference in their entirety.

TECHNICAL FIELD

The present disclosure relates to the field of robots, and more particularly, to a method for detecting a skidding of a robot, a mapping method and a chip.

BACKGROUND

During the cleaning process of an intelligent cleaning robot, wheels are likely to skid due to obstacles or when traveling on the relatively wet and smooth ground. At this time, an odometer on the wheels will still calculate the distance of wheel skidding into a travel distance. In this way, a travel distance error is caused, so that the robot will introduce this error in mapping, resulting in an error in a built map that is not accurate. At present, there is a way to judge whether skidding occurs by comparing a speed of a driving wheel and a speed of a driven wheel of the robot. However, in order to obtain the speed of the driven wheel, an additional odometer must be mounted on the driven wheel, which will increase the cost of the robot. Meanwhile, due to the uncontrollability of the driven wheel (such as suspended idling), if the mode is used to judge whether the robot is in the skidding state, there will be misjudgments and the accuracy is not high enough.

SUMMARY

A method for detecting a skidding of a robot includes the following steps: a first angle change rate generated by two driving wheels within a preset time period is calculated; a second angle change rate generated by a gyroscope within the preset time period is calculated; a difference between the first angle change rate and the second angle change rate is determined as a first difference; a maximum error value of the first angle change rate is determined; a ratio of the first difference to the maximum error value is determined as an angular velocity change error rate; it is determined whether the angular velocity change error rate is greater than or equal to a preset value; when the angular velocity change error rate is greater than or equal to the preset value, it is determined that the robot is in a skidding state; when the angular velocity change error rate is less than or equal to the preset value, it is determined that the robot is in a normal state.

A robot mapping method includes the following steps: based on the above method for detecting a skidding of a robot of robot skidding, a grid where a position point of the robot in the skidding state is located is determined; the grid is marked as a skidding grid.

A chip is configured to store a program for controlling a robot to execute the above mapping method.

DETAILED DESCRIPTION OF THE EMBODIMENTS

The Detailed Description of the Embodiments of the present disclosure is further described below with reference to the accompanying drawings.

Sweeping robots, also known as automatic sweepers and smart vacuum cleaners, is a type of intelligent household appliances that can automatically complete floor cleaning in a room by virtue of certain artificial intelligence. Generally, brush sweeping and vacuum modes are used to absorb ground debris into its own garbage storage box to complete the function of floor cleaning. Generally speaking, robots that perform cleaning, vacuuming and floor cleaning are also unified as a sweeping robots. A body 10 of a sweeping robot is a wireless machine, and is mainly a disc type. A rechargeable battery is used to operate, an operation mode being a remote control or an operation panel on the machine. Generally, time can be set to schedule cleaning and the sweeping robot can recharge itself. The body 10 is equipped with various sensors that can detect a travel distance, a travel angle, a body status, an obstacle and the like. If encountering a wall or other obstacles, it will turn on its own and walk in different routes according to different settings for planned region cleaning.

Figure 1:
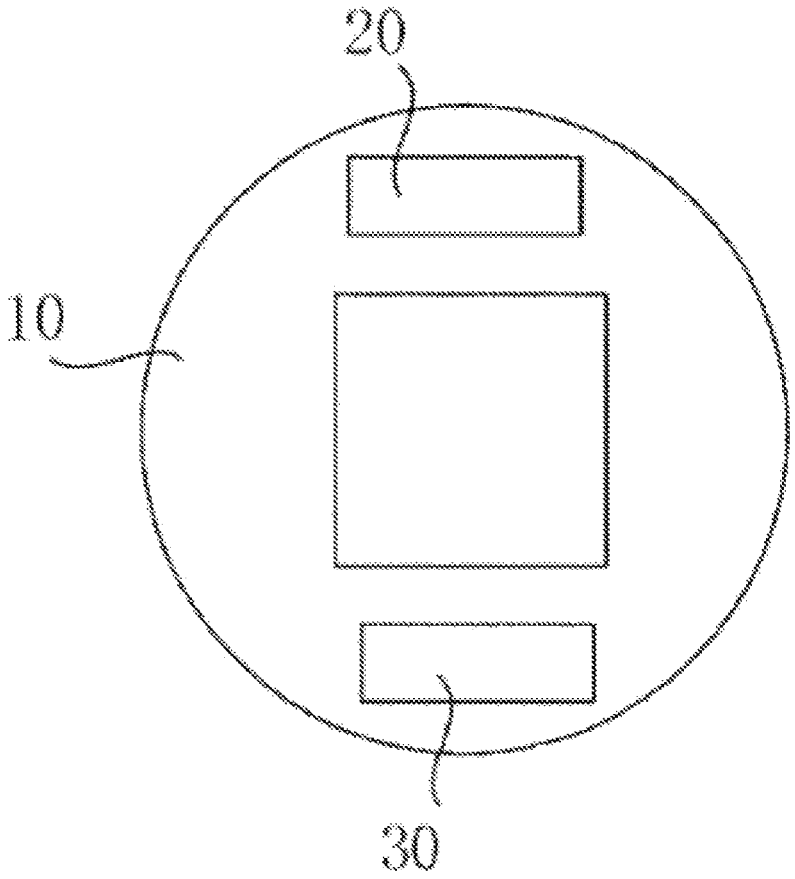
FIG. 1 is a schematic structural diagram of a robot according to the present disclosure.

As shown in FIG. 1, the robot according to the present disclosure includes the following structure: a robot body 10 capable of traveling autonomously with a first driving wheel 20 and a second driving wheel 30, inertial sensors in inside of the robot, an odometer 60 (generally a code disc) for detecting the travel distance of the driving wheel, and a processor 50 capable of processing parameters of related sensors and outputting control signals to execution components, and inertial sensors include an accelerometer and a gyroscope 40 etc. the odometer 60 is arranged on the first driving wheel 20 and the second driving wheel 30.

Figure 2:
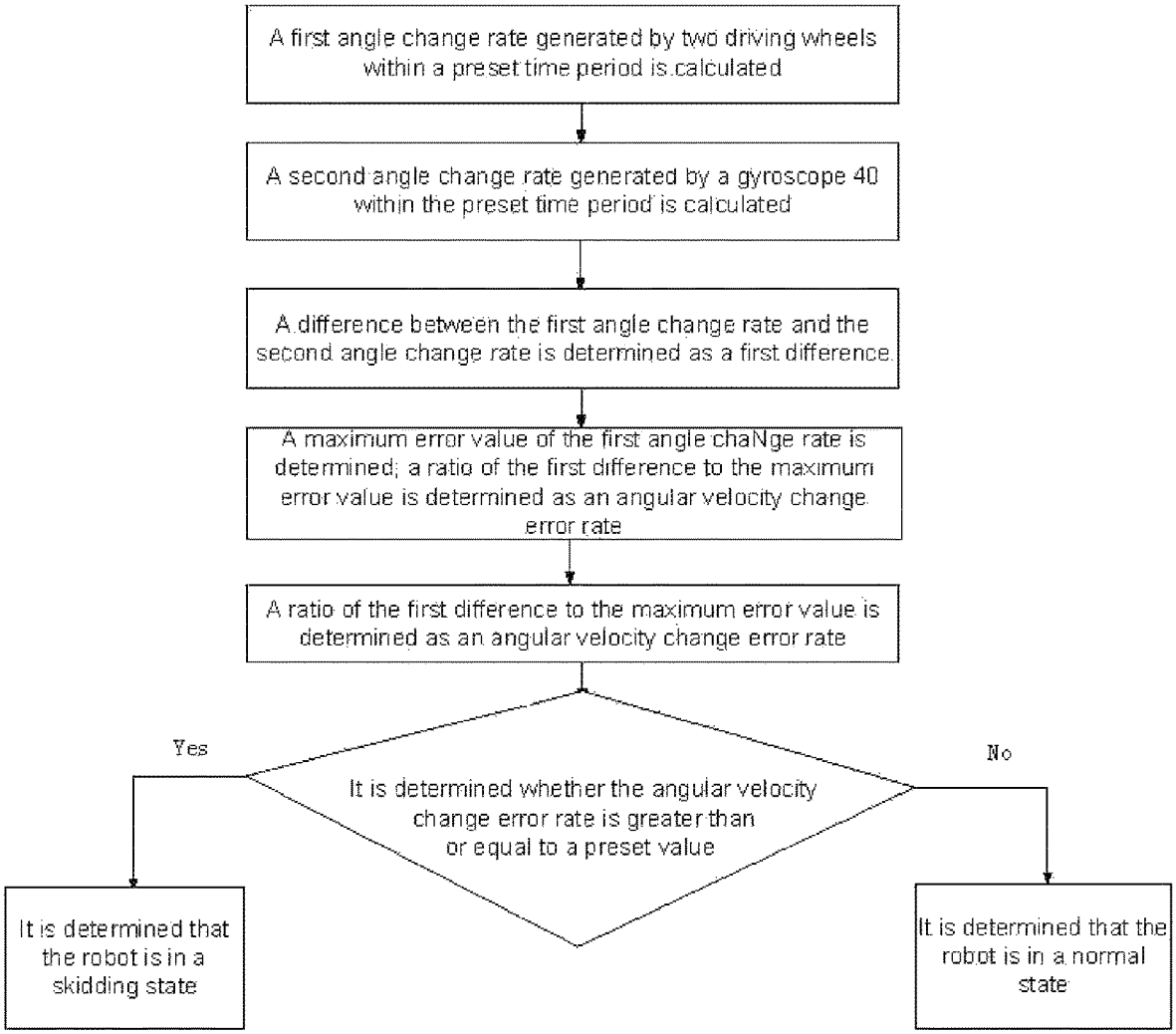
FIG. 2 is a flowchart of a method for detecting a skidding of a robot according to the present disclosure.
Figure 3:
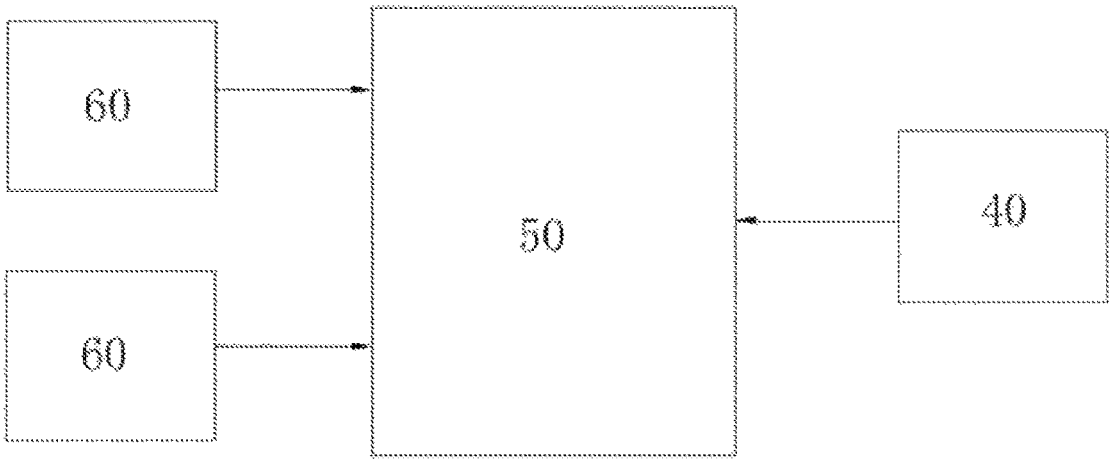
FIG. 3 is a block diagram of a detection system for robot skidding according to the present disclosure.

As shown in FIG. 2, a method for detecting a skidding of a robot includes the following steps: a first angle change rate generated by two driving wheels within a preset time period is calculated; a second angle change rate generated by a gyroscope 40 within the preset time period is calculated; a difference between the first angle change rate and the second angle change rate is determined as a first difference; a maximum error value of the first angle change rate is determined; a ratio of the first difference to the maximum error value is determined as an angular velocity change error rate; it is determined whether the angular velocity change error rate is greater than or equal to a preset value; when the angular velocity change error rate is greater than or equal to the preset value, it is determined that the robot is in a skidding state; when the angular velocity change error rate is less than or equal to the preset value, it is determined that the robot is in a normal state. According to the method for detecting a skidding of a robot of the present disclosure, through the odometer 60 on existing driving wheels of the robot, the gyroscope 40 in the body 10, and the processor 50 (as shown in FIG. 3) in the body 10, the first angle change rate generated by two driving wheels within the preset time period and the second angle change rate generated by the gyroscope 40 within the preset time period are detected and calculated, so as to determine the angular velocity change error rate of the robot. Finally, by determining whether the angular velocity change error rate is greater than or equal to the preset value, it is determined whether the robot is in the skidding state. The method for detecting a skidding of a robot has relatively low costs. Meanwhile, the method of performing detection and judgment by combining the odometer 60 and the gyroscope 40 has a relatively high accuracy. When it is detected that the robot is in the skidding state, skidding data is recorded, and travel data of the robot is corrected to avoid the impact of skidding on the travel accuracy of the robot.

Figure 4:
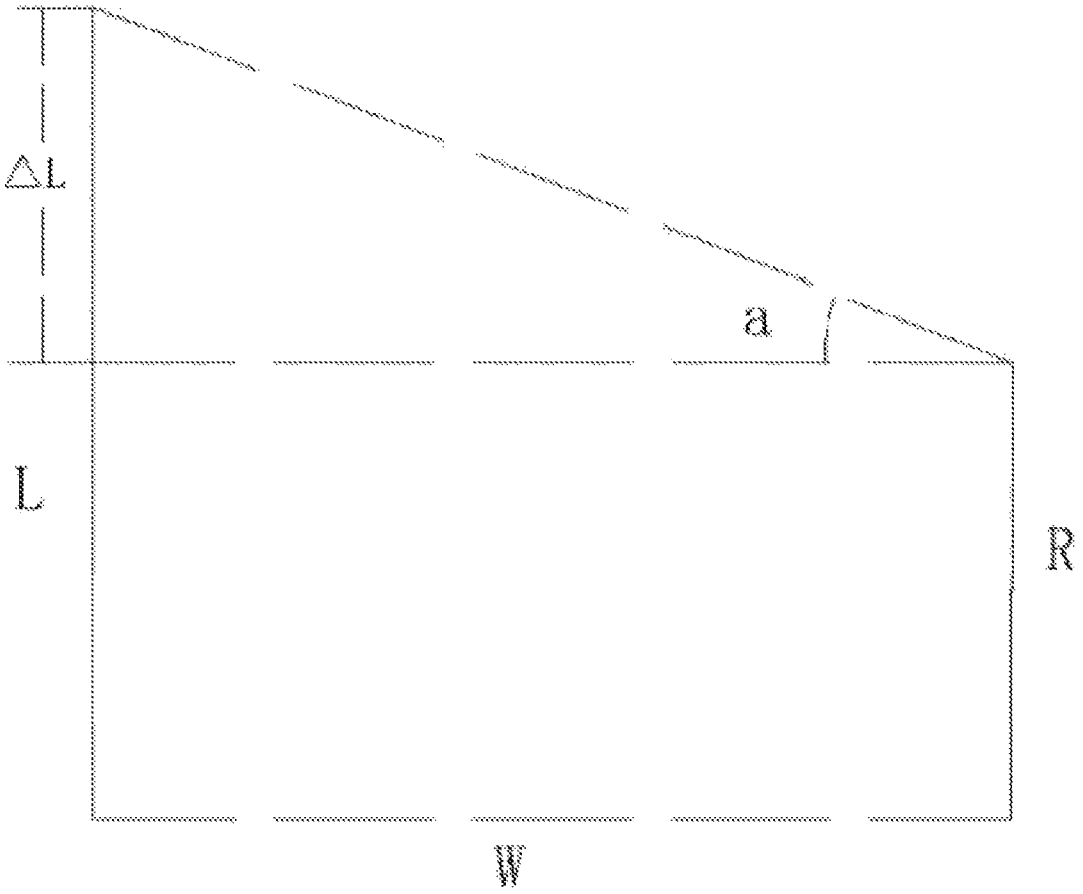
FIG. 4 is a schematic analysis diagram of a travel angle value according to the present disclosure.

In some embodiments, calculating the first angle change rate generated by two driving wheels within the preset time period comprises following steps: a travel distance difference between the two driving wheels within the preset time period is calculated; a width between the two driving wheels is determined; a ratio of the travel distance difference to the width is determined as a travel angle value of the two driving wheels within the preset time period; a ratio of the travel angle value to the preset time period is determined as the first angle change rate. As shown in FIG. 4, if the robot is in the skidding state, the distances traveled by the two driving wheels may be different (for example, one driving wheel skids and the other driving wheel does not skid, or the frictions between the two driving wheels and the ground are different, etc., which will cause the number of rotations of the wheels caused by the skidding of the driving wheels to be different, that is, the distances traveled by the two driving wheels are different), so that the robot will generate a slight deflection, thereby generating a tiny arc-shaped travel trajectory. However, for the convenience of description, as shown in FIG. 4, the travel trajectories of the first driving wheel 20 and the second driving wheel 30 are represented in straight line forms, and a resulting error is within a predictable range. In FIG. 4, a distance traveled by the first driving wheel 20 within the preset time period T detected by the odometer 60 is L, and a distance traveled by the second driving wheel 30 within the preset time period detected by the odometer 60 is R. Therefore, after receiving detection data of the odometer 60, the processor 50 calculates a travel distance difference between the two driving wheels within the preset time period as $\Delta L$. Since a width between the two driving wheels is W, a travel angle value of the two driving wheels within the preset time period is calculated as a, $a=\Delta L/W$. Finally, the first angle change rate is calculated as P, $P=a/T=\Delta L(WT)$. By means of the small-angle method for detecting a skidding of a robot, the angle change rate obtained in each preset time period is beneficial to subsequent calculation of an angle error change rate, and the accuracy of finally determining whether the robot is in the skidding state can be improved.

In some embodiments, calculating the travel distance difference between the two driving wheels within the preset time period comprises the following steps: a difference between a first current travel distance and a first previous travel distance is calculated as a first distance traveled by a first driving wheel 20 of the two driving wheels, and the first current travel distance being a travel distance of the first driving wheel 20 detected at a current recording time point, and the first previous travel distance being a travel distance of the first driving wheel 20 detected at a previous recording time point; a difference between a second current travel distance and a second previous travel distance is calculated as a second distance traveled by a second driving wheel 30 of the two driving wheels, and the second current travel distance being a travel distance of the second driving wheel 30 detected at the current recording time point, and the second previous travel distance being a travel distance of the second driving wheel 30 detected at the previous recording time point; a difference between the first distance and the second distance is determined as the travel distance difference a time interval between the current recording time point and the previous recording time point is the preset time period. By analyzing and comparing the travel distances detected at each recording time point, the travel distance difference between the two driving wheels in each time period of different time periods can be obtained, calculation data is provided for the angle change rate in each time period of different time periods, and the subsequent calculation accuracy of the angle change rate is ensured.

In some embodiments, calculating the second angle change rate generated by the gyroscope 40 within the preset time period comprises the following steps: a difference between a current angle and a previous angle is calculated as a change angle, the current angle being a angle detected by the gyroscope 40 at a current recording time point, the previous angle being a angle detected by the gyroscope 40 at a previous recording time point; a ratio of the change angle to the preset time period is determined as the second angle change rate. A time interval between the current recording time point and the previous recording time point is the preset time period. Since the gyroscope 40 has high accuracy in angle detection, the angle change rate calculated by the detection data of the gyroscope 40 already provided inside the robot is accurate. Meanwhile, by performing data detection at the corresponding recording time points, accurate data comparison can be performed, thereby avoiding subsequent calculation errors of an angular error change rate due to errors in the comparison data, and ensuring the judgment accuracy of robot skidding.

In some other embodiments, determining the maximum error value of the first angle change rate comprises the following steps: a maximum error rate of each driving wheel is determined; a product of the first angle change rate and the maximum error rate is determined as the maximum error value. Because the two driving wheels have errors in a physical structure, the error rate of the same physical structure is very close. Therefore, the maximum error rate can be obtained by experimental testing, or multiple sets of tested data can be averaged as the maximum error rate. By introducing the maximum error rate to determine the maximum error value of the first angle change rate, an accurate basis can be provided for subsequent data processing, thereby avoiding the occurrence of misjudgment caused by direct reference to error data, and improving the accuracy of judging whether the robot is in the skidding state.

In some other embodiments, determining whether the angular velocity change error rate is greater than or equal to the preset value further comprises the following steps: according to the angular velocity change error rates determined at N consecutive times, it is determined whether the angular velocity change error rate determined at each time is greater than or equal to a preset value; when the angular velocity change error rate obtained at each time is greater than or equal to the preset value, it is determined that the angular velocity change error rate is greater than or equal to the preset value; when the angular velocity change error rate obtained at a certain time is less than the preset value, it is determined that the angular velocity change error rate is less than or equal to the preset value. Because the traveling road conditions of the robot are very complicated and different road conditions will have different effects on the detection results of the robot, determining whether the robot is in the skidding state or not by relying on only one data detection and judgment may be not accurate. Multiple consecutive detections should be performed, and the results of multiple detections should be analyzed. Only when they are all satisfied, skidding can be determined, so that the results obtained have higher accuracy. N can be set correspondingly according to specific situations. In some embodiments, it is set to a natural number greater than or equal to 2. In some other embodiments, it is set to 5. If it is too small, an accurate effect cannot be achieved. If it is too large, computing resources will be wasted.

In some embodiments, a ratio of the first difference to the maximum error value is determined as an angular velocity change error rate. Because the first angle change rate is different each time, the maximum error value obtained is also different, that is to say, the maximum error value each time is dynamically changed. If a fixed absolute value is used as a reference for judgment, the result obtained will have a large error. The method of the present disclosure adopts a comparison mode. Judging according to the ratio of the comparison can obtain more accurate results.

In some embodiments, the preset value is 1, so that the relationship between the first difference value and the maximum error value can be accurately defined, so as to effectively judge whether the robot is in a skidding state according to the comparison result.

In some other embodiments, the preset time period is 10 ms. Of course, it may also be set to other values according to different requirements. 10 ms is more appropriate. If the time is too long, the detection result will be affected. If the time is too short, the performance requirements of the sensor and the processor 50 will be too high.

A robot mapping method of the present disclosure includes the following steps: based on the method for detecting a skidding of a robot of robot skidding, a grid where a position point of the robot in the skidding state is located is determined; the grid is marked as a skidding grid. In the building of a grid map, the robot needs to mark the grid according to the detection situation correspondingly. For example, when an obstacle is detected, the grid where a position point of the obstacle is detected is marked as an obstacle grid. When a cliff is detected, a grid where a position point of the cliff is detected is marked as a cliff grid. Since methods known to the inventors cannot accurately detect whether the robot is in the skidding state, it is impossible to accurately mark the skidding grid, resulting in subsequent robots navigating into the skidding area during navigation based on the grid map, so that the travel efficiency is reduced, and the navigation effect is poor. Through the mapping method of the present disclosure, the skidding grid is accurately marked, and the built map has high accuracy. In the subsequent navigation process, the robot will avoid the skidding area, thereby improving the travel efficiency and navigation effect of the robot.

The chip of the present disclosure is configured to store a program for controlling a robot to execute the above mapping method. Because the chip has a higher accuracy of mapping, the performance of the chip is better.

The above embodiments are only sufficient disclosure rather than limitation of the present disclosure, and any replacement of equivalent technical features based on the creative spirit of the present disclosure without creative labor shall be regarded as the scope disclosed in this application.

What is claimed is:

1. A robot mapping method, the mapping method is applied to processor, the mapping method comprising:

navigating a space with a robot comprising two driving wheels and a gyroscope to bald a grid map, calculating a first angle change rate generated by the two driving wheels within a preset time period;

calculating a second angle change rate generated by the gyroscope within the preset time period, determining a difference between the first angle change rate and the second angle change rate as a first difference;

determining a maximum error value of the first angle change rate;

determining a ratio of the first difference to the maximum error value as an angular velocity change error rate;

determining whether the angular velocity change error rate is greater than or equal to a preset value;

when the angular velocity change error rate is greater than or equal to the preset value, determining that the robot is in a skidding state;

when the angular velocity change error rate is less than the preset value, determining that the robot is in a normal state:

determining a grid element where a position point of the robot in the skidding state is located on the gird map:

creating an updated grid map by marking the grid element as a skidding grid element on the grid map, and navigating the robot according to the updated grid map, so that the robot avoids the location of the skidding grid element in future navigation paths of the space;

calculating the first angle change rate generated by two driving wheels within the preset time period comprises following steps:

calculating a travel distance difference between the two driving wheels within the preset time period, determining a width between the two driving wheels:

determining a ratio of the travel distance difference to the width as a travel angle value of the two driving wheels within the preset time period; and determining a ratio of the travel angle value to the preset time period as the first angle change rate.

2. A chip, configured to store a program for controlling a robot to execute the mapping method as claimed in claim 1.

3. A robot mapping method as claimed in claim 1, wherein calculating the travel distance difference between the two driving wheels within the preset time period comprises:

calculating a difference between a first current travel distance and a first previous travel distance as a first distance traveled by a first driving wheel of the two driving wheels, and the first current travel distance being a travel distance of the first driving wheel detected at a current recording time point, and the first previous travel distance being a travel distance of the first driving wheel detected at a previous recording time point;

calculating a difference between a second current travel distance and a second previous travel distance as a second distance traveled by a second driving wheel of the two driving wheels, and the second current travel distance being a travel distance of the second driving wheel detected at the current recording time point, and the second previous travel distance being a travel distance of the second driving wheel detected at the previous recording time point;

determining a difference between the first distance and the second distance as the travel distance difference, wherein a time interval between the current recording time point and the previous recording time point is the preset time period.

4. A robot mapping method as claimed in claim 1, wherein calculating the second angle change rate generated by the gyroscope within the preset time comprises:

calculating a difference between a current angle and a previous angle as a change angle, the current angle being a angle detected by the gyroscope at a current recording time point, the previous angle being a angle detected by the gyroscope at a previous recording time point;

determining a ratio of the change angle to the preset time period as the second angle change rate, wherein a time interval between the current recording time point and the previous recording time point is the preset time period.

5. A robot mapping method as claimed in claim 1, wherein determining the maximum error value of the first angle change rate comprises:

determining a maximum error rate of each driving wheel;

determining a product of the first angle change rate and the maximum error rate as the maximum error value;

wherein the maximum error rate is obtained through experimental tests.

6. A robot mapping method as claimed in claim 1, wherein determining whether the angular velocity change error rate is greater than or equal to the preset value further comprises:

determining, according to angular velocity change error rates determined at N consecutive times, whether the angular velocity change error rate obtained at each time is greater than or equal to the preset value;

when the angular velocity change error rate obtained at each time is greater than or equal to the preset value, determining that the angular velocity change error rate is greater than or equal to the preset value; and when the angular velocity change error rate determined at a certain time is less than the preset value, determining that the angular velocity change error rate is less than the preset value, wherein N is a natural number greater than or equal to 2.

7. A robot mapping method as claimed in claim 1, wherein the preset value is 1.

8. A robot mapping method as claimed in claim 1, wherein the preset time period is 10 ms.

* * * * *